US006311827B1

(12) United States Patent
Draghetti

(10) Patent No.: US 6,311,827 B1
(45) Date of Patent: Nov. 6, 2001

(54) DEVICE FOR SUPPLYING CIGARETTES ON A CONDITIONING MACHINE WITH TWO PACKING LINES

(75) Inventor: Fiorenzo Draghetti, Medicina (IT)

(73) Assignee: G.D Societa' per Azioni, Pomponia (IT)

( * ) Notice: Subject to any disclaimer, the term of this patent is extended or adjusted under 35 U.S.C. 154(b) by 0 days.

(21) Appl. No.: 09/441,807

(22) Filed: Nov. 17, 1999

(30) Foreign Application Priority Data

Nov. 18, 1998 (IT) ..... B098A0640

(51) Int. Cl.[7] ..... B65G 47/30
(52) U.S. Cl. ..... 198/418.1; 198/448
(58) Field of Search ..... 198/418.1, 448; 221/93

(56) References Cited

U.S. PATENT DOCUMENTS 3,106,282 * 10/1963 Schmermund ..... 198/418.1

FOREIGN PATENT DOCUMENTS 923 009 A 4/1963 (GB) .

* cited by examiner

*Primary Examiner*—Kenneth W. Noland
(74) *Attorney, Agent, or Firm*—Marshall, Gerstein & Borun

(57) ABSTRACT

A device for supplying cigarettes on a conditioning machine with two packing lines has a hopper with four outlets; an intermittent conveyor having a succession of pockets arranged with a given spacing, and extending along a straight path located at the outlets and at a supply station for supplying the packing lines; and an ejector for simultaneously transferring respective groups from the four outlets to respective successive, adjacent pockets during a stop phase of the conveyor; the outlets being arranged with the aforementioned given spacing.

2 Claims, 1 Drawing Sheet

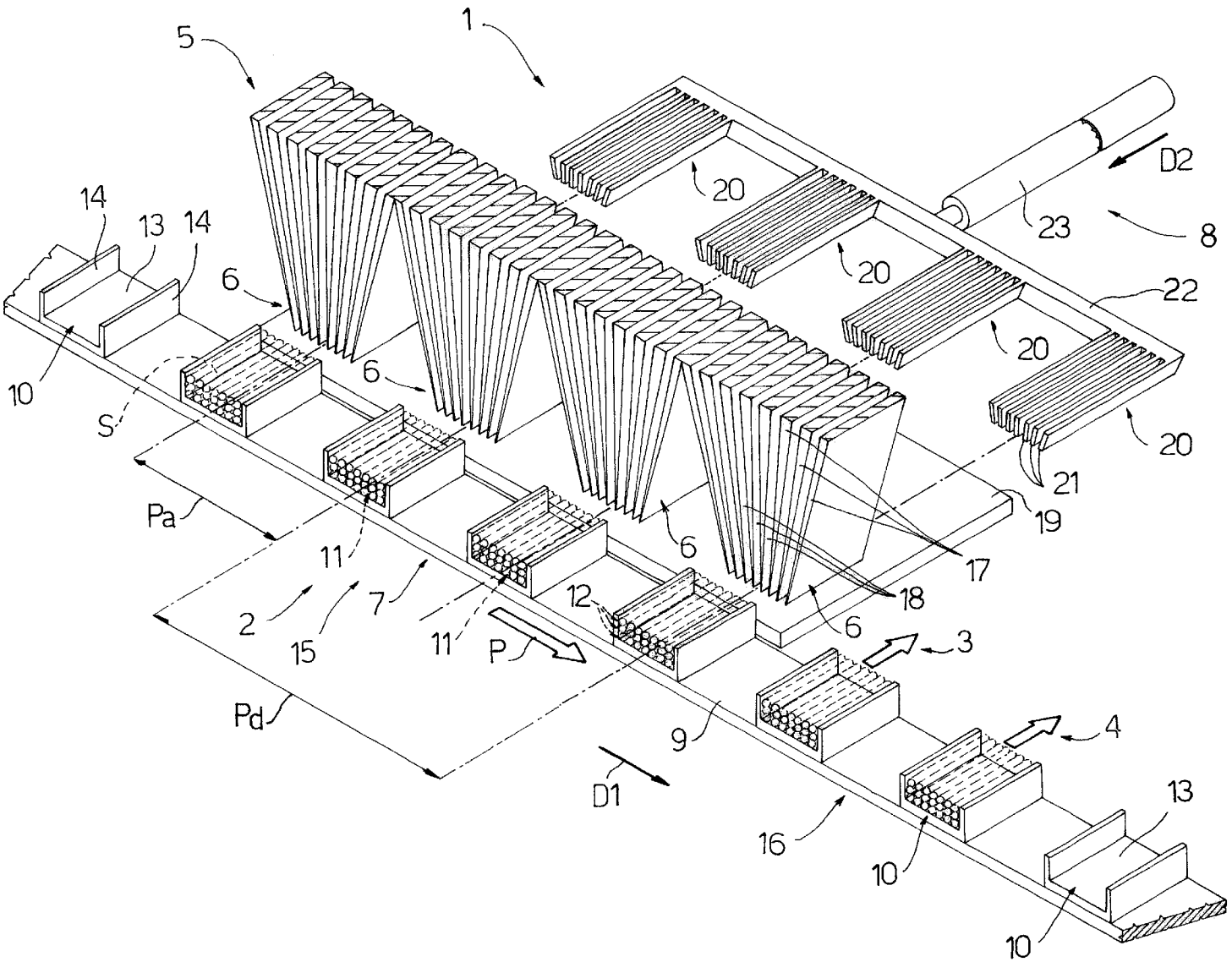
D2
8
22
20
23
21
19
17
18
6
3
4
13
10
16
9
D1
12
P
11
7
15
2
Pd
Pa
S
14
5
1

DEVICE FOR SUPPLYING CIGARETTES ON A CONDITIONING MACHINE WITH TWO PACKING LINES

The present invention relates to a device for supplying cigarettes on a conditioning machine with two packing lines.

BACKGROUND OF THE INVENTION

Devices for supplying cigarettes on a conditioning machine with two packing lines normally comprise a hopper having a number of outlets for arranging masses of equioriented cigarettes into layers comprising a given number of cigarettes; an ejecting device for successively ejecting the layers from the outlets of the hopper; and a conveyor for receiving the layers and forming groups of cigarettes comprising superimposed layers, and which are then fed to the two packing lines of the conditioning machine.

A cigarette conditioning machine with two packing lines has twice the output of a single-packing-line type and therefore calls for simultaneously forming a large number of groups of cigarettes for supply to the two packing lines. Since the traveling speed of the cigarettes along the outlets depends, however, on the force of gravity acting on the cigarettes and cannot be increased over and above a given limit, increasing the number of groups means increasing the number of outlets for each individual layer, thus resulting in the formation of extremely large, cumbersome hoppers with a large number of outlets.

U.S. Pat. No. 3,106,282 discloses a devices for supplying cigarettes on a conditioning machine with two packing lines and having a hopper provided with four outlets. In this supplying device a batch of cigarettes is extracted from a respective outlet and is fed to a respective pocket of an intermediate conveyor by a relevant "U" shaped slide. Successively, the intermediate conveyor is moved so as to position the pocket with the batch of cigarettes in front of a relevant packing line in order to feed the batch to such packing line.

However, the supplying device disclosed in U.S. Pat. No. 3,106,282 is relatively complicated, thus expensive, and cumbersome. Furthermore, the reciprocating movement of the intermediate conveyor does not allow the supplying device to work at a relatively high operating speed as required by the modern double-lines cigarette packaging machines.

SUMMARY OF THE INVENTION

It is an object of the present invention to provide a device for supplying cigarettes on a conditioning machine with two packing lines, designed to eliminate the aforementioned drawbacks, and which in particular comprises a compact hopper.

According to the present invention, there is provided a device for supplying cigarettes on a conditioning machine with two packing lines as recited by claim 1.

BRIEF DESCRIPTION OF THE DRAWING

The present invention will be described with reference to the accompanying drawing, which shows a cigarette conditioning machine having two packing lines and featuring a non-limiting embodiment of the device according to the invention.

DETAILED DESCRIPTION OF THE INVENTION

Number 1 in the accompanying drawing indicates a machine for conditioning cigarettes S and comprising a device 2 for supplying cigarettes S to two parallel packing lines 3 and 4.

Device 2 comprises a hopper 5 having four identical, substantially vertical outlets 6; a pocket conveyor 7; and an ejector 8. Conveyor 7 comprises a work branch 9 extending along a given path P in a substantially horizontal direction D1, and a number of pockets 10 equally spaced with a spacing Pa and for receiving respective groups 11 of cigarettes S, which groups are each defined by three layers 12 and each comprise a given number of cigarettes S. Each pocket 10 comprises a bottom wall 13 and two lateral walls 14 for retaining an orderly group 11.

Path P extends through a forming station 15 for forming groups 11 at outlets 6 of hopper 5, and through a supply station 16 for supplying packing lines 3 and 4 and where groups 11 are transferred, by known means not shown, to and for packing along respective lines 3 and 4.

Each outlet 6 comprises a number of partitions 17 defining feed channels 18 for cigarettes S; and a substantially horizontal supporting plate 19 is provided beneath outlets 6 to support groups 11 formed by outlets 6.

Outlets 6 are arranged alongside path P and work branch 9 of conveyor 7 with the same spacing Pa as pockets 10; and the upper face of plate 19 is coplanar with the upper faces of bottom walls 13 of pockets 10 along work branch 9.

Ejector 8 comprises four combs 20 located at respective outlets 6 and on the opposite side of outlets 6 to conveyor 7. Each comb 20 comprises a number of fingers 21 extending in a substantially horizontal direction D2 perpendicular to direction D1, and which engage respective channels 18 to expel one group 11 at a time from respective outlet 6. Combs 20 are connected to one another by a bar 22 extending in direction D1 and which in turn is connected rigidly to a rod 23 extending in direction D2 and movable back and forth in direction D2 to move the combs into a work position, i.e. with respective fingers 21 inside respective channels 18, and into a rest position in which combs 20 are located on the opposite side of hopper 5 to conveyor 7.

In actual use, cigarettes S travel down channels 18 of outlets 6 on to plate 19 to form respective groups 11. Conveyor 7 is operated intermittently in alternate stop-go phases, and, during each go phase, each pocket 10 is moved forward one step Pd equal to twice the spacing Pa of pockets 10 to position a pocket 10 and respective group 11 at each of the two packing lines 3 and 4 at each step Pd. When four successive, adjacent empty pockets 10 are positioned by conveyor 7 at outlets 6 of hopper 5, ejector 8 is activated and moved from the rest position towards conveyor 7 in direction D2 to eject and transfer a respective group 11 from each outlet 6 into a respective pocket 10. Ejector 8 is then withdrawn into the rest position to enable cigarettes S to drop down channels 18 and form further groups 11 on plate 19; and the cycle is repeated upon conveyor 7 completing two steps Pd, i.e. upon a further four empty pockets 10 being positioned by the conveyor at outlets 6.

Device 2 is particularly advantageous by enabling the formation of a relatively compact hopper, on account of the outlets 6 of the hopper simultaneously expelling whole groups 11 of cigarettes S, so that the number of outlets is reduced, and the spacing of outlets 6 is particularly small and equal to spacing Pa of pockets 10. Moreover, operating the ejector every two steps Pd of conveyor 7 allows the cigarettes more time to drop down channels 18 and form groups on plate 19.

What is claimed is:

1. A device for supplying cigarettes on a conditioning machine with two packing lines, the device comprising a hopper having four outlets; an intermittent close-loop conveyor having succession of pockets, which are equally spaced with a given spacing (Pa) in respect to each other and are advanced by said conveyor in a given direction (D1) along a path (P) located at said outlets and at a supply station for supplying said two packing lines, said supply station being located along said path (P) downstream of said outlets in respect to said given direction (D1); and an ejector for simultaneously transferring respective groups from said outlets into respective successive, adjacent pockets during a stop phase of the conveyor; said outlets being arranged with said spacing (Pa); and said path being straight at least at said outlets; wherein said conveyor is operated in steps (Pd), each step being equal to twice said spacing (Pa).

2. A device as claimed in claim 1, wherein said ejector comprises four combs integral with an actuating rod; the ejector being activated every two steps (Pd) of said conveyor.

* * * * *